United States Patent [19]

Jones

[11] Patent Number: 4,726,731

[45] Date of Patent: Feb. 23, 1988

[54] HITCH

[76] Inventor: Paul O. Jones, 40A Smithfield Road, St. Johns Park, New South Wales, 2176, Australia

[21] Appl. No.: 749,944

[22] Filed: Jun. 27, 1985

[30] Foreign Application Priority Data

Dec. 7, 1984 [AU] Australia ..... PG8468

[51] Int. Cl.[4] ..... E02F 3/28

[52] U.S. Cl. ..... 414/723; 74/522; 172/272; 403/61; 403/85

[58] Field of Search ..... 414/723; 172/272, 749; 403/85, 113, 61, DIG 8; 74/522

[56] References Cited

U.S. PATENT DOCUMENTS

| | | | |
|---|---|---|---|
| 2,142,454 | 1/1939 | Needham | 172/645 |
| 2,497,319 | 2/1950 | Mott | 74/593 |
| 3,204,793 | 9/1965 | Lane | 414/715 |
| 3,269,570 | 8/1966 | Wallberg | 414/723 |
| 3,705,656 | 12/1972 | Hunger et al. | 172/273 X |
| 3,935,953 | 2/1976 | Stedman | 414/723 X |
| 4,013,182 | 3/1977 | Pratt et al. | 414/723 |
| 4,067,467 | 1/1978 | Datta et al. | 172/275 X |
| 4,068,959 | 1/1978 | Pemberton | 414/723 X |
| 4,116,347 | 9/1978 | Uchida | 414/723 |
| 4,119,225 | 10/1978 | Macht et al. | 172/273 X |
| 4,179,225 | 12/1979 | Asplund | 403/322 |
| 4,187,050 | 2/1980 | Barbee | 414/723 |
| 4,214,840 | 7/1980 | Beales | 403/31 |
| 4,239,225 | 12/1980 | Burnside | 74/522 X |
| 4,243,342 | 1/1981 | Marto | 403/324 |
| 4,253,793 | 3/1981 | Braml | 414/723 |
| 4,295,287 | 10/1981 | Natzke et al. | 414/723 X |
| 4,297,074 | 10/1981 | Ballinger | 414/723 |
| 4,345,872 | 8/1982 | Arnold | 414/705 |
| 4,355,945 | 10/1982 | Pilch | 414/723 X |
| 4,436,477 | 3/1984 | Lenertz et al. | 414/723 |

FOREIGN PATENT DOCUMENTS

| | | |
|---|---|---|
| 77154/81 | 11/1981 | Australia . |
| WO81/03192 | 4/1981 | PCT Int'l Appl. . |
| WO82/02731 | 2/1982 | PCT Int'l Appl. . |
| 1602951 | 11/1981 | United Kingdom . |
| 616375 | 7/1978 | U.S.S.R. . |
| 618501 | 8/1978 | U.S.S.R. . |

OTHER PUBLICATIONS

Report on U.S. Patent Searches Concerning Hydraulic Hitch for Excavator, Aug. 12, 1983.

*Primary Examiner*—Robert J. Spar
*Assistant Examiner*—Donald W. Underwood
*Attorney, Agent, or Firm*—Basile and Hanlon

[57] ABSTRACT

A quick release hitch for attaching an implement to the arm of a hydraulic excavator comprises a pair of pivotted links, each link having a jaw for engaging a pin on the implement; the links can be jack-knifed to engage or disengage the implement; and locking structures are provided for locking the links together when the implement has been engaged. Preferably, the locking structure is a rotatable cam and/or over-center mechanism.

1 Claim, 14 Drawing Figures

HITCH

FIELD OF THE INVENTION

The present invention relates to a quick-release hitch for attachment to the arm of an excavator. The hitch allows implements to be changed automatically by the driver of the excavator without the driver having to leave his control cab.

PRIOR ART

In my Australian patent specification No. 18602/83 there is disclosed a quick release hydraulic hitch which fits between the arm of a conventional excavator and a conventional implement, so that no modification of either the excavator or the implement is required. A number of embodiments are described and in each case the implement is attached to the hitch bymeans of a hydraulic mechanism. The hydraulic mechanism is required to be pressurised in order to safely retain the implement.

A potential disadvantage of this earlier system is that accidental leakage of the hydraulic mechanism can cause the implement to become detached, with dangerous consequences.

THE AIMS

It is an object of the present invention to provide a hitch having a mechanical or semi-mechanical locking system, whereby once the implement has been attached, it is possible to deactivate the hydraulic system (or other engaging system) without the implement becoming detached.

In the present specification, the term "excavator" will be understood to have a wide meaning covering all at the end of an arm, and therefore includes not only hydraulic excavators as such but also backhoes.

A wide variety of implements may be used with the hydraulic excavator, for example the implement might be a bucket, auger, drill, tamper, a ripping-tooth, a hydraulic drill, a grader blade, or any of the other commercially available implements. Each implement will be provided with pin holes to enable it to be attached to the dipper and to the tipping links of the excavator. Such implements are conventionally provided with a pair of pins extending through the pin holes and the hitch of the present invention is designed to co-operate with these pins, without requiring any permanent modifications.

THE INVENTION

The present invention provides a quick-release hitch for attachment to the arm of an excavator, the hitch being adapted to pick up and retain an implement provided with a pair of parallel transversely extending spaced pins; which hitch comprises:

- a first and a second longitudinally extending link,
- ends of the links being pivotally connected together, and the free end of each link having a jaw for embracing a respective implement pin;
- locking means for locking the links together against relative pivotal movement when the implement has been engaged by the hitch; and
- attachment means for attaching the hitch to the excavator arm.

The locking means may be a locking pin passing through apertures in the links, a sliding tongue on one link slidable into the other link, or other known locking means. Advantageously, the locking means comprises a rotatable cam element on one link which engages a ramp surface on the other link, thereby allowing locking together of the links in a range of pivotal positions with respect to each other.

Alternatively or additionally, the locking means may comprise an over-centre locking mechanism. The term "over-centre mechanism" will be understood to mean a mechanism wherein the pivotal connection of the links in the engaged position is over-centre, either with respect to a line joining attachment points (of the attachment means) where the dipper and tipping link are attached to the hitch (giving partial locking); or also over-centre with respect to the jaws of the hitch (giving complete locking).

In a simple embodiment, the links are thrown over-centre by gravity due to the weight of the locking mechanism, or by manipulation of the excavator arm, to capture the implement.

However, a drive means may be provided for pivoting the links. The drive means may be a hydraulic motor, hydraulic ram or an equivalent electrically or mechanically operated mechanism. Usually, the drive means is arranged to at least disengage the hitch by jack-knifing the links. This reduces the distance between the jaws and disengages the hitch from the implement pins.

Means may also be provided for sliding the links longitudinally relatively to one another, so as to allow for slight variations in pin spacing. This may be done using an eccentric shaft running freely through one link and journalled into the second link. The shaft is operated by a motor secured to said one link.

The jaws of the hitch may face towards or away from each other for engaging the implement pins from the outside or inside, respectively.

BRIEF DESCRIPTION OF THE DRAWINGS

Embodiments of the present invention will now be described by way of example only, with reference to the drawings wherein.

DETAILED DESCRIPTION OF PREFERRED EMBODIMENTS

Figure 1:
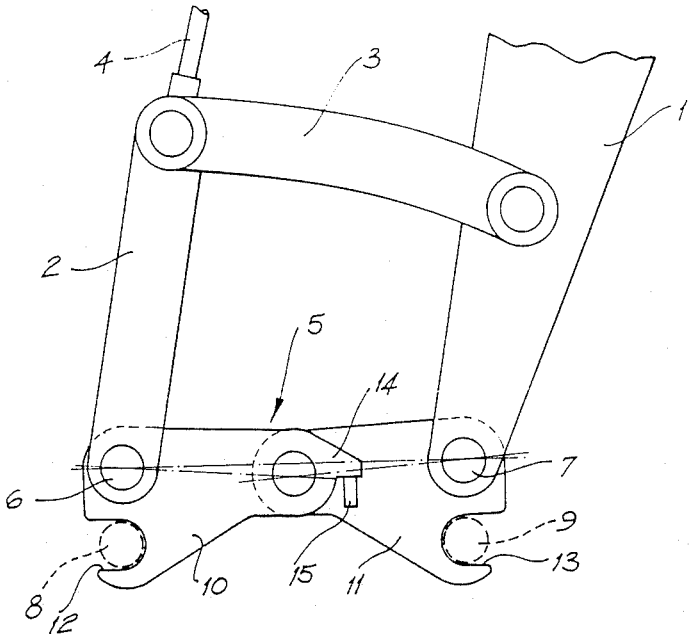
FIG. 1 is a side elevation of the end of an excavator arm carrying a hitch according to a first embodiment of the invention.
Figure 2:
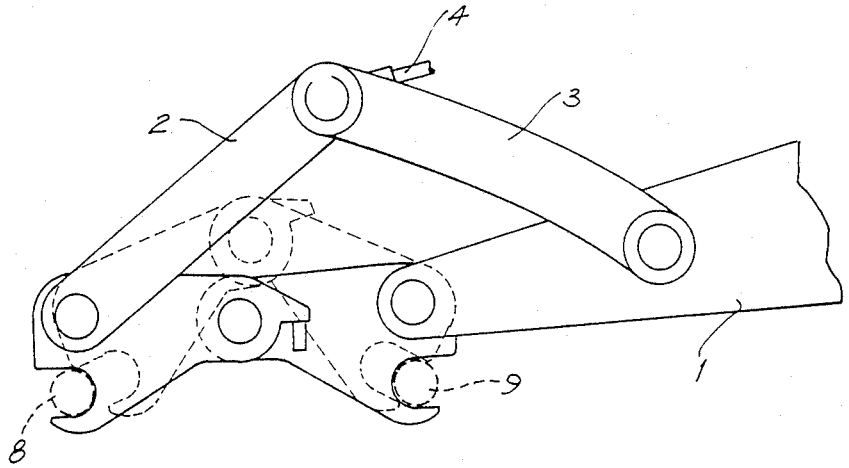
FIG. 2 shows the hitch being unlocked from an implement.
Figure 3:
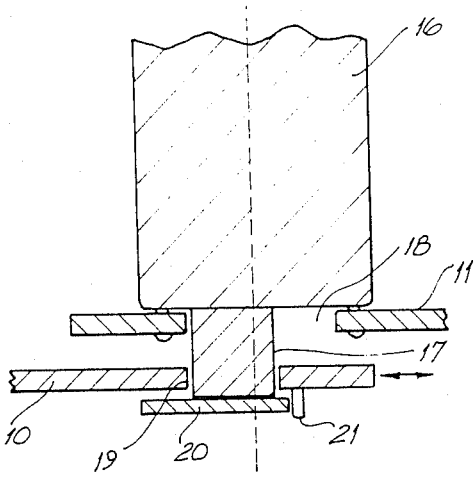
FIGS. 3 and 4 are partial cross-sectional views from above showing an over-centre locking mechanism in the locked and unlocked positions respectively.
Figure 4:
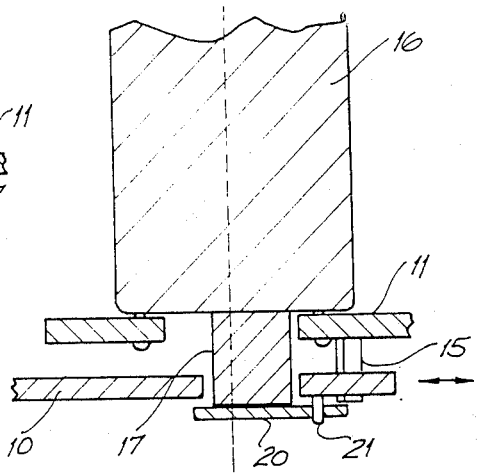
Figure 5:
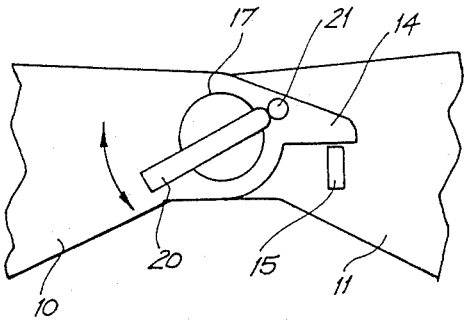
FIGS. 5 and 6 are partial side elevations to an enlarged scale of the over-centre locking mechanism in the locked and unlocked positions respectively.
Figure 6:
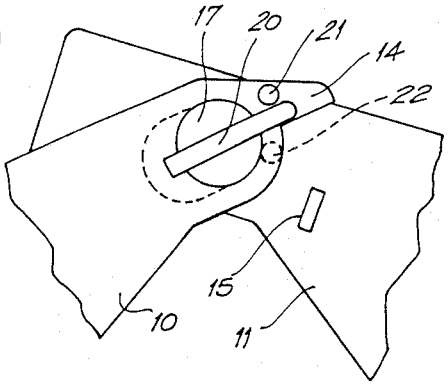

The hitch is attached to an excavator arm comprising a dipper 1, a tipping link 2 and a pair of crowd links 3 in conventional manner. A hydraulic cylinder (not shown) acts on rod 4 for tipping the implement towards the position shown in FIG. 2.

FIGS. 1 to 6 show a hitch 5 according to a first embodiment of the invention. The hitch 5 is shown generally in FIGS. 1 and 2 (from which some details are omitted) and in more detail in FIGS. 3 to 6. The hitch is attached by means of pivot pins 6 and 7 to the tipping link 2 and dipper 1 respectively of the excavator. Numerals 8 and 9 indicate a pair of parallel spaced pins provided on the implement e.g. a bucket.

The hitch 5 comprises an outer link 10 and an inner link 11. The links 10, 11 are pivotally connected at the centre by means to be described below and their free ends are provided with respective jaws 12, 13 for embracing implement pins 8, 9 respectively. The links are locked over-centre (with respect to pivot pins 6 and 7) when a beak 14 provided on outer link 10 abuts a stop 15 on inner link 11.

The over-centre locking mechanism is shown in more detail in FIGS. 3 to 6. A rotary hydraulic motor 16 is bolted to inner link 11 and carries an eccentric shaft 17 which extends freely through an aperture 18 in the inner link. Eccentric shaft 17 is bushed into a circular bushing 19 in outer link 10 and constitutes the pivotal connection between links 10 and 11.

An arm 20 is fixed to the end of shaft 17 and co-operates with a projection 21 on outer link 10 for throwing the mechanism over-centre for disengagement.

The hitch 5 may be operated, to release an implement, as follows. The excavator arm is brought down to the position shown in FIG. 2, with the implement attached and the over-centre locking mechanism in the position shown in FIGS. 3 and 5. The hydraulic motor 16 is then operated so as to rotate shaft 17 in an anti-clockwise direction from the position shown in FIG. 5. Shaft 17 is eccentrically mounted and rotates about the axis of rotation shown in dotted lines, thereby retracting outer link 10 longitudinally towards inner link 11 and reducing the distance between jaws 12 and 13. This partially releases the implement pins 8, 9. Further anti-clockwise rotation of shaft 17 causes the end of arm 20 to abut against projection 21, thereby throwing the locking mechanism over-centre and causing links 10 and 11 to jack-knife to the position shown in FIGS. 4 and 6. In this position the jaws 12, 13 are fully detached from implement pins 8, 9 and the excavator arm can be moved to pick-up a fresh implement.

When the hitch 5 has been aligned above a fresh implement, hydraulic motor 16 is reversed and shaft 17 rotated in a clockwise direction. This allows links 10 and 11 to straighten from the position shown in FIGS. 4 and 6 over-centre until beak 14 rests against stop 15, due to the weight of the links and the hydraulic motor. There after, further clockwise rotation of shaft 17 extends outer link 10 relative to inner link 11, thus allowing for any variations in spacing of the implement pins 8, 9.

In the above described embodiment, the links are moved over-centre (with respect ot the pivots 6 and 7) under the effect of gravity. In another form of the invention the links may be positively moved over-centre by the provision of a further protrusion 22 shown in dotted lines in FIG. 6. Bushing 19 is elongated as shown in dotted lines. For engagement of the hitch, eccentric shaft 17 is rotated clockwise until arm 20 strikes protrusion 22, which throws the mechanism over-centre. On further rotation, the elongated bushing 19 allows arm 20 to ride over pin 22 and to continue extension of the links until the implement pins 8, 9 are firmly engaged. Other arrangements for allowing the arm 20 to ride over pin 22 may also be envisaged, such as allowing arm 20 to slide longitudinally across the end of shaft 17 once the mechanism has been thrown over-centre.

The eccentric mounting of shaft 17 allows for a certain degree of longitudinal movement of the links 10, 11 relative to one another (usually about 20 to 30 mm). In order to allow the hitch to cope with variations in implement pin spacing in excess of this, provision may be made for sliding the motor 16 longitudinally relative to the inner link 11, for example by unbolting the motor, or by rotating the motor in an eccentric arrangement mounted on the inner link 11.

In order to operate the hitch, the motor 16 need not rotate more than 180°. It is therefore possible to replace the motor by means of a ram acting on an arm extending transversely of shaft 17. The hydraulic motor might also be replaced by an electric motor.

Figure 7:
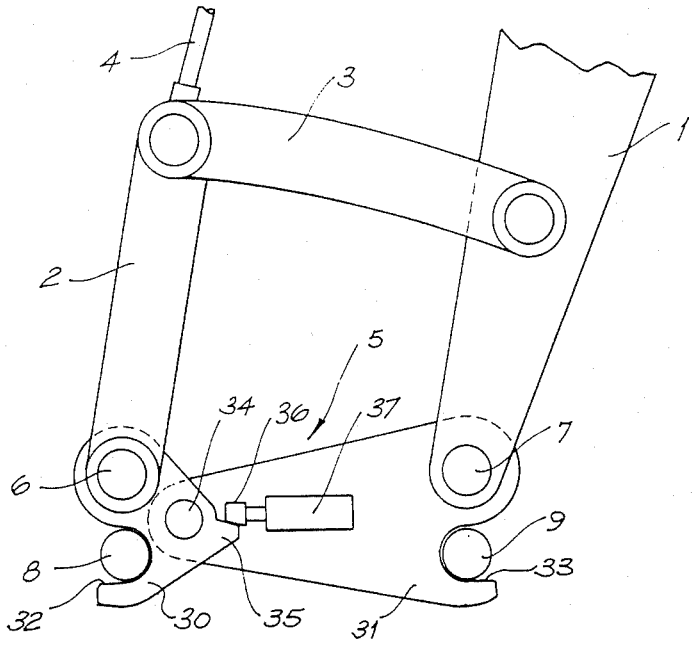
FIGS. 7 and 8 show side elevations of a second embodiment of the invention, having a sliding ram locking means.
Figure 8:
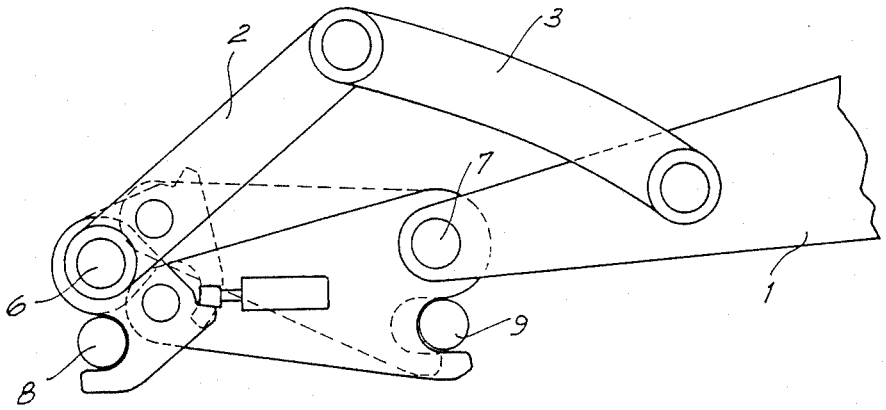

FIGS. 7 and 8 show a second embodiment of the invention wherein a hitch 5 comprises an outer link 30 and inner link 31 having respective jaws 32 and 33 for embracing implement pins 8, 9. The links are pivotally mounted at 34 and there is no provision for longitudinal movement of the links relative to one another. Outer link 30 is provided with a nose 35 having a ramp surface. A cylinder 37 is attached to inner link 31 and operates a ram 36 having a further ramp surface abutting nose 35.

Hitch 5 is operated as follows. With the hitch 50 in the jack-knifed position shown in dotted lines in FIG. 8, the links are positioned over implement pins 8, 9. The links are then allowed to fall over-centre (with respect to pivot pins 6 and 7) by gravity until jaws 32 and 33 embrace implement pins 8, 9 respectively. Cylinder 37 is then operated to extend ram 36, thereby bearing against nose 35 and pushing the hitch further over-centre until the jaws firmly engage the implement pins 8, 9. For removal, ram 36 is retracted and the excavator arm is lifted so as to jack-knife links 1 and 2 and allow the implement to be released.

Figure 9:
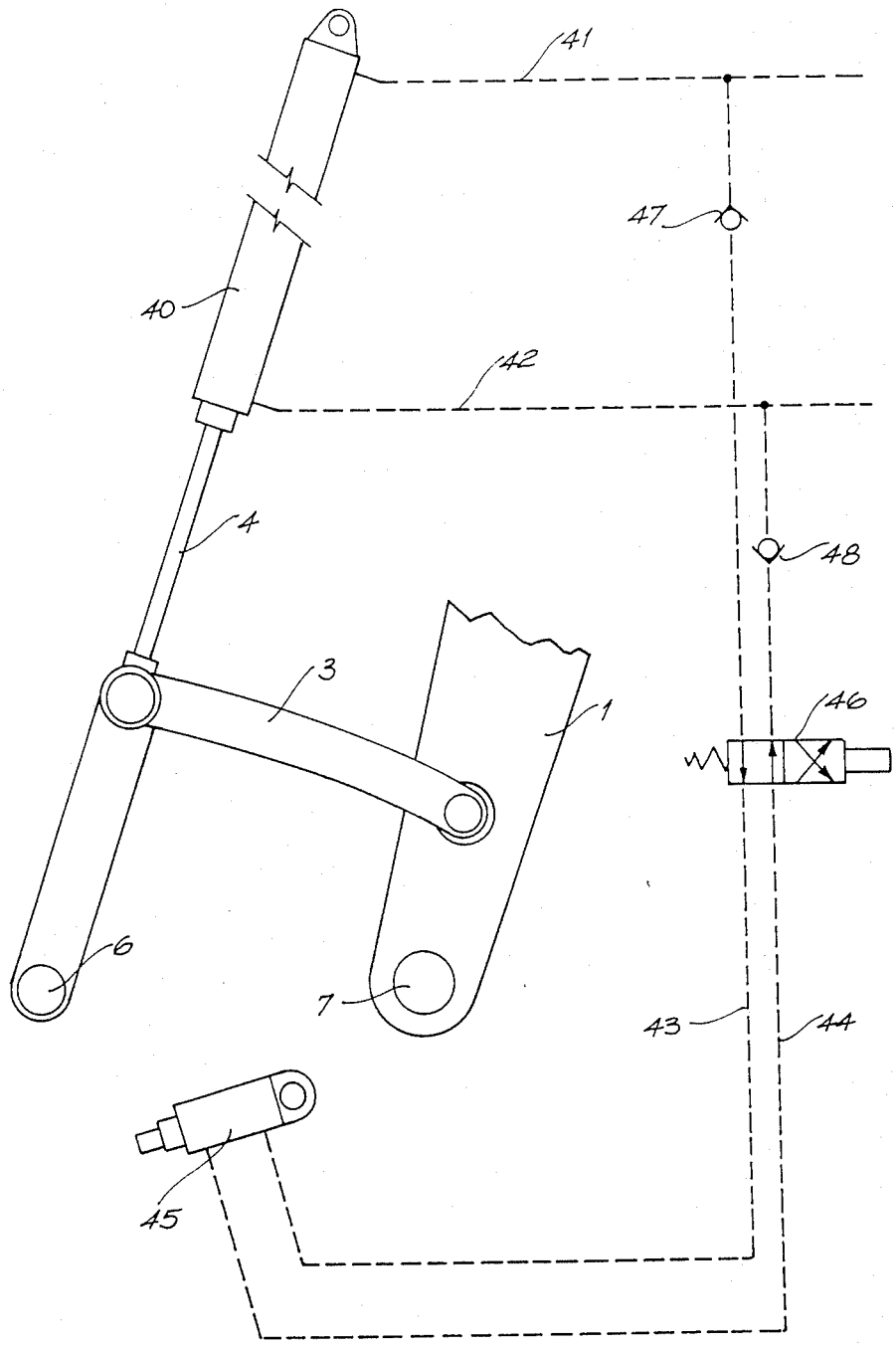
FIG. 9 shows a hydraulic control circuit for use with the hitch.

FIG. 9 shows a hydraulic control circuit for use with the embodiments described previously. The excavator is provided with a tipping cylinder 40 and ram 4, and hydraulic inlet and outlet lines 41, 42 respectively for hydraulic fluid. Parallel lines 43, 44 lead to hydraulic means 45 (e.g. motor or cylinder) whose direction of operation is controlled by reversing solenoid control valve 46. Non return valves 47, 48 are provided in lines 43, 44 respectively. With this arrangement, if leakage occurs, the double non-return valve arrangement will stop the hitch hydraulic means from becoming depressurised. In normal operation, increase pressure in tipping cylinder 40 such as encountered during digging) causes simultaneous pressured increase in hydraulic means 45 tending to maintain the hitch jaws firmly closed. This provides additional protection against accidental detachment of the implement.

Figure 10:
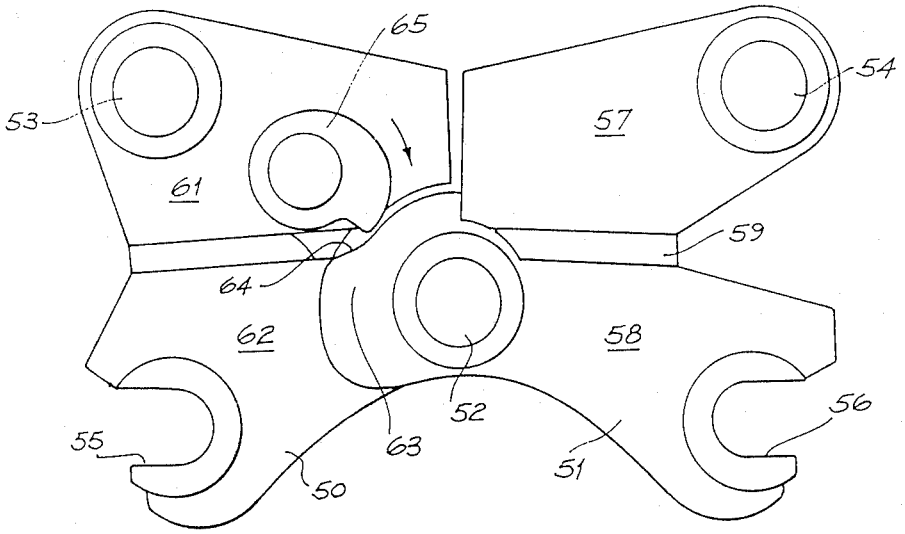
FIG. 10 is a side elevation of a third embodiment of the invention having a rotatable cam locking means.
Figure 11:
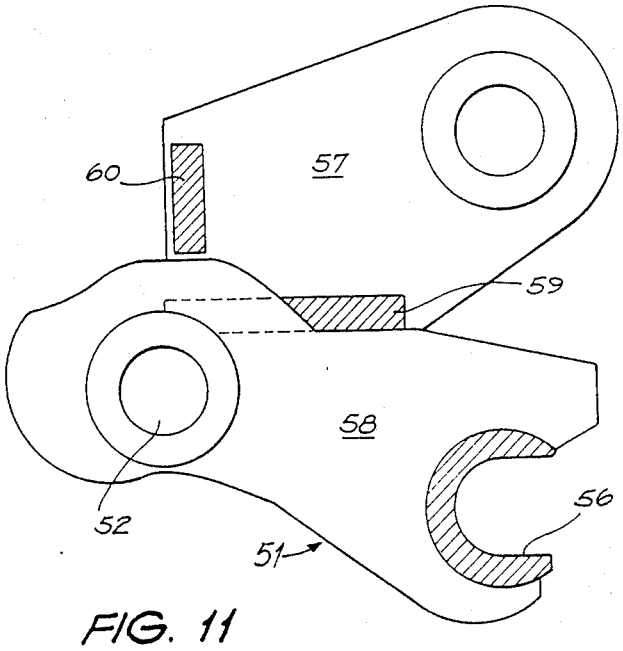
FIG. 11 is a longitudinal cross-sectional view of one of the links of the third embodiment.

FIGS. 10 and 11 show a third embodiment having a rotatable cam locking means. This comprises an inner link 50 and outer link 51 pivotally connected by pivot 52. The links have respective attachment points 53 and 54 for pivotal attachment to the dipper and tipping link of an excavator, and respective jaws 55 and 56 for engaging the implement pins.

As shown more clearly in FIG. 11 the outer link 51 comprises a pair of spaced upper flanges 57 and a pair of spaced lower flanges 58 interconnected by a plate 59 and bar 60. Jaw 56 consists of a part-cylindrical channel element extending transversely of the hitch. Similarly, the inner link 50 comprises a pair of interconnected upper and lower flanges 61 and 62 respectively.

The locking means comprises a nose 63 formed as an extension of lower flange 58, and which overlaps lower flange 62. Each lower flange 58 has a ramp surface 64 which is engaged by a rotatable cam 65 mounted on each upper flange 61. The cam is rotatable by a hydraulic motor (not shown). Rotation of the cam in engagement wth ramp surface 64 pivots the links and moves jaws 55, 56 apart until they firmly engage the implement pins. The hydraulic motor may then be deactivated without danger of the hitch becoming disengaged from the implement.

Figure 12:
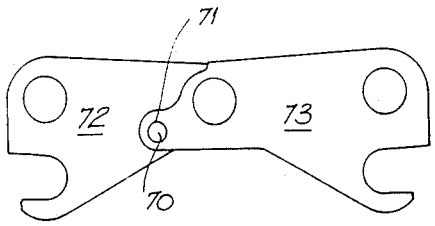
FIG. 12 is a schematic elevation of a forth embodiment having a locking pin.

FIG. 12 is a schematic view of a fourth embodiment which is generally similar to the previous embodiments but which employs transversely slidable locking pins 70 as the locking means. A pair of locking pins are slidable in apertures in the inner links 72 by a hydraulic cylinder (not shown). When the hitch is engaged, the pins are slid out into corresponding apertures 71 in outer links 73 to lock the links together.

Figure 13:
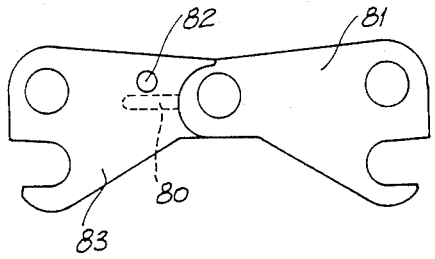
FIG. 13 is a schematic elevation of a fifth embodiment having a sliding tongue locking means.

FIG. 13 is a schematic view of a fifth embodiment which uses a sliding tongue locking means. The sliding tongue 80 is operated by a hydraulic cylinder mounted on outer link 81. The tongue engages under a transverse rod 82 on inner link 83 to lock the links together.

Figure 14:
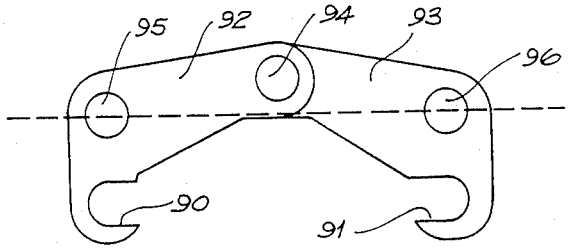
FIG. 14 is a schematic elevation of a sixth general embodiment wherein the jaws are arranged to engage the implement pins from the outside.

FIG. 14 is a schematic view of a sixth embodiment having inward facing jaws 90 and 91 on the outer and inner links 92, 93 respectively, for embracing the implement pins from the outside thereof. In the engaged position, the pivot 94 of the links is over-centre both with regard to the implement pins and to attachment points 95 and 96 of the dipper and tipping link. Additional locking means as described above may also be used if necessary.

I claim:

1. A quick-release hitch for attachment to the arm of an excavator having a dipper and a tipping link, the hitch being adapted to pick up and retain an implement provided with a pair of parallel transversely extending spaced pins; which hitch comprises:

a first longitudinally extending link having a first attachment point for attachment to the tipping link of said excavator arm;

a second longitudinally extending link having a second attachment point for attachment to the dipper of said excavator arm;

said first and second links being pivotally connected together end to end to allow jack-knifing thereof, and the free end of each link having a respective first and second jaw for embracing a respective implement pin; and a mechanical locking means mounted on one of said first and second links and operative on the other of said links for mechanically locking said links together against relative pivotal movement when the implement has been engaged by the hitch, wherein the locking means comprises a rotatable cam element mounted on one link which engages a ramp surface provided on the other link, thereby allowing locking together of the links in a range of pivotal positions with respect to each other.

* * * * *